United States Patent [19]

Meijer

[11] Patent Number: 4,612,759

[45] Date of Patent: Sep. 23, 1986

[54] METHOD OF AND DEVICE FOR PROVIDING A CONCENTRIC LAYER OF WIRE MATERIAL ON A CABLE

[75] Inventor: Johan F. R. Meijer, Zaandam, Netherlands

[73] Assignee: N.K.F. Groep B.V., Rijswijk, Netherlands

[21] Appl. No.: 744,164

[22] Filed: Jun. 12, 1985

[30] Foreign Application Priority Data

Jun. 15, 1984 [NL] Netherlands ..... 8401894

[51] Int. Cl.[4] ..... H01B 13/26; H01B 13/08

[52] U.S. Cl. ..... 57/17; 57/3; 57/6; 57/18; 57/352

[58] Field of Search ..... 57/16–18, 57/352, 6, 3, 90, 59, 64

[56] References Cited

U.S. PATENT DOCUMENTS

| | | | |
|---|---|---|---|
| 1,734,704 | 11/1929 | Yancey | 57/17 X |
| 2,200,955 | 5/1940 | Keating | 57/17 |
| 2,365,277 | 12/1944 | Keating | 57/17 |
| 2,595,138 | 4/1952 | Hamilton | 57/17 |
| 3,718,577 | 2/1973 | Nai et al. | 208/108 |
| 3,726,075 | 4/1973 | Akachi | 57/59 |
| 4,450,674 | 5/1984 | Bos et al. | 57/3 X |

FOREIGN PATENT DOCUMENTS

| | | |
|---|---|---|
| 1113486 | 9/1961 | Fed. Rep. of Germany . |
| 1316001 | 5/1973 | United Kingdom . |
| 1339757 | 12/1973 | United Kingdom . |
| 1502507 | 3/1978 | United Kingdom . |

*Primary Examiner*—John Petrakes

*Attorney, Agent, or Firm*—Robert T. Mayer

[57] ABSTRACT

A method of and a device for providing a concentric layer of wire material on a cable (C), in which a number of wires (G) are taken simultaneously and in a tangential direction off a common rotating feed reel (27) on which the wires (G) are wound parallel to one another. The wires (G) are guided into the axial direction, are spread in the circumferential direction and are wrapped around the cable (C), which passes through a hollow shaft (11) supporting the feed reel (27). The method can be used both for armouring cables and for providing a screening.

4 Claims, 3 Drawing Figures

METHOD OF AND DEVICE FOR PROVIDING A CONCENTRIC LAYER OF WIRE MATERIAL ON A CABLE

The invention relates to a method of providing a concentric layer of wire material on a cable, in which several wires are taken off feed-reel means and are wrapped with a given pitch around the cable as it is moved along a rectilinear transport path.

The wire material may consist of steel wires, which may be provided with an envelope, in which event the concentric layer may serve as an armoring for the mechanical protection of energy supply cables or telephone cables. Alternatively, the wire material may consist of copper wires, which may be provided with an insulation sheath, in which event the concentric layer may serve as an electrical screening and as an outer conductor for telephone cables or other signal transmission cables; the copper wires may be provided on the cable so as to engage each other or with a given distance between adjacent wires.

A method of the kind mentioned in the opening paragraph is known from European Patent Specification EP 0 013 047, to which U.S. Pat. No. 4,450,674 corresponds. In this known method the wires are taken off feed-reel means comprising separate feed reels, i.e. one reel per wire, which are journalled in a rotatable cage and during rotation of the cage move along one or more circular orbital paths around a cable to be wrapped. The diameter of the circular orbital paths is determined by the number of reels moving along the same path. Owing to the fact that the linear speed of the cable to be wrapped is in a given ratio to the speed of rotation of the cages, the wires are wound around the cable with a given pitch. The maximum permissible number of revolutions per unit of time is mainly determined by the diameter of the circular paths and by the mass of the full reels and is comparatively low, which also results in a low linear speed of the cable. Another result of this comparatively low speed is that the process cannot be carried out immediately before or immediately after another processing step, such as providing a sheath by an extrusion process, because these other processing steps are generally carried out at higher linear speeds. Therefore, a concentric layer of wire material is generally provided in a separate processing step.

The invention has for its object to provide a method of forming a concentric layer of wire material on a cable, which can be carried out at an essentially higher production speed and in a more economical manner than the known method and which can be carried out immediately before and/or immediately after further processing steps in a continuous process.

According to the invention, this object is mainly achieved in that a plurality of wires are taken simultaneously and in a tangential direction off at least one common rotating feed reel, which is arranged coaxially with the transport path of the cable and on which the wires are wound parallel to and beside each other, the wires are directed from the tangential direction into the direction of the cable, are spread in the circumferential direction and are finally wrapped around the cable with the same relative pitch distance.

Due to the measures according to the invention, the production speed, i.e. the linear speed of the cable, can be considerably increased. Due to the fact that the reel does not follow an orbital path and only rotates about its axis, the inertia forces occurring are considerably smaller than in the known process and a comparatively high speed of rotation of the reel is permissible. For processing the most frequently occurring cable types, the reel has a speed of rotation of about 500 rpm, while with the use of the conventional method the speed of rotation of the cage and hence the orbital speed of the reels is limited to 150 to 200 rpm. The comparatively high speed of rotation of the reel results in an increase of the production speed, i.e. of the linear speed of the cable. In a practical example the production speed could be increased from 30 m per minute when carrying out the conventional process to 100 m per minute when using the method according to the invention.

In the device also known from the afore-mentioned U.S. Pat. No. 4,450,674, each wire to be processed is wound on a separate feed reel. The number of wires with which the cable has to be wrapped determines the number of reels which move in the device along one or more circular orbital paths and hence the length of the device. Due to the fact that in the method according to the invention, several wires are wound on the same feed reel, the number of reels has decreased, as a result of which the length of the device is reduced. Besides an increase in the production speed, the measures according to the invention result in a reduction in the cost of the machine by about a factor 6. The general increase in efficiency is substantial. The step of winding the wires on the feed reel parallel to and beside each other can take place immediately after the step of drawing the wires on a suitable multiple drawing machine or in a separate processing step. It should be ensured that the length of all wires wound on the same reel is substantially equal because otherwise disturbances can occur when the wires are taken off the reel. Due, moreover, to the fact that according to the invention the wires are taken simultaneously and in a tangential direction off the same feed reel and also due to the fact that the reel does not perform a translatory movement along an orbital path but performs only a rotary movement about its own axis, the separate wires are less heavily loaded by centrifugal forces and a higher tensile force can be exerted on each wire, the risk of rupture being smaller than in the conventional method.

The number of the wires wound parallel to and beside each other and on the same feed reel depends upon the diameter of these wires; the thicker the wires, the smaller is the number of wires per feed reel. It will be appreciated that, if necessary, a larger number of wires can be distributed over two or more reels. In general, eight to ten wires can be wound on the same reel. In order to facilitate a regular spreading of the wires over the circumference of the cable, the wires will generally be distributed over at least two reels.

According to a preferred embodiment of the method in accordance with the invention, on said layer of wire material a second concentric layer of wire material is provided, the wires for the second layer being taken off at least one further rotating feed reel, which, viewed in the direction of transport of the cable, is arranged behind the first feed reel, the arrangement being such that the wires of the second layer are wrapped crosswise over the first layer in a helical direction opposite to that of the wires in the first layer.

Due to these measures, two concentric layers can be formed in succession on a cable, the wires of one layer and the wires of the other layer crossing each other. This embodiment of the method according to the invention is particularly suitable for providing an outer conductor comprising two wire layers on a coaxial cable for replacing the conventional outer conductor comprising a mesh of a large number (about 50) of very thin wires having a diameter of about 0.5 mm. The conventional step of braiding the thin wires to form an outer conductor takes place in a slow and hence expensive process at a comparatively low speed. With the method according to the invention the outer conductor comprising two layers can be formed at a considerably higher speed due to the fact that the thin wires, as already set out above, are subjected to only comparatively small forces.

In general, the concentric layer of wire material will be formed on an inner sheath of synthetic material, which has been applied beforehand to the cable. After the layer of wire material has been formed, an outer sheath of synthetic material is extruded around the cable so that the layer of wire material is embedded between the two sheaths.

A cable, more particularly a coaxial cable, provided with an outer conductor comprising two concentric layers of wire material applied by means of the method according to the invention is characterized by the characteristic pattern of the two concentric layers, whose wires cross each other. An outer sheath can be applied to this cable by extrusion.

The invention further relates to a device for carrying out the method according to the invention comprising a rotatable magazine accommodating at least one feed reel, guide means, a stationary nipple, a drive for the magazine and a drive for the transport of a cable to be wrapped. According to the invention this device is characterized in that the magazine has a hollow rotatable shaft which serves as a support for at least one guide wheel and for a distributor disk and on which the feed reel is coaxially journalled so as to be freely rotatable relative thereto, this hollow shaft at the same time serving as a passage for the cable to be wrapped. The device having the above characteristics constitutes a compact unit, especially in the axial direction, has a comparatively simple construction and has a low sensitivity to interference. Due to the fact that the feed reel rotates about its axis, a comparatively large supply of wire can be wound on the feed reel without the risk of the device being overloaded due to the occurrence of impermissible inertia forces.

The number of feed reels accommodated in the same magazine is dependent upon the number of wires to be processed. As already mentioned above, normally eight to ten wires will be wound on the same reel and the number of wires to be processed will be distributed over at least two feed reels.

A preferred embodiment of the device according to the invention is characterized by at least one further magazine comprising at least one feed reel, a guide wheel and a distributor disk, by a second nipple and by a separate drive for the further magazine, the two magazines being arranged in series.

This preferred embodiment of the device according to the invention, having at least two magazines mounted in series, is particularly suitable for providing two concentric layers one on the other with the wires of one layer crossing the wires of the other layer, and which layers, when provided on a coaxial cable, act as an outer conductor.

The invention will be described more fully with reference to the drawings. In the drawings.

Figure 1:
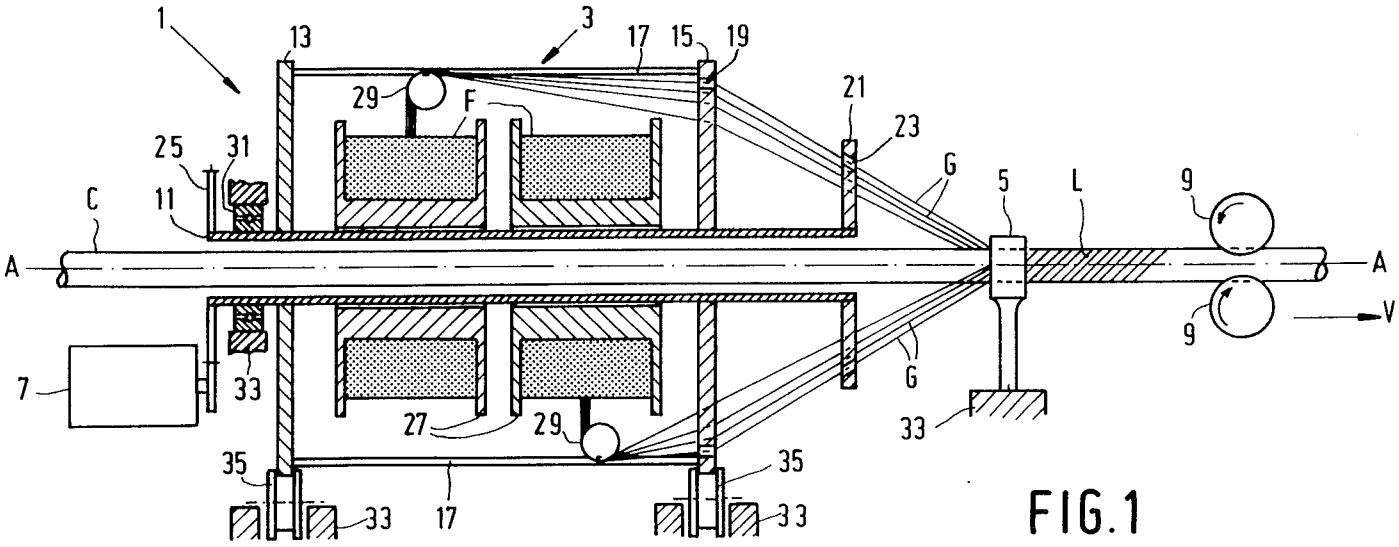
FIG. 1 shows diagrammatically an embodiment of the device according to the invention in longitudinal sectional view.
Figure 2:
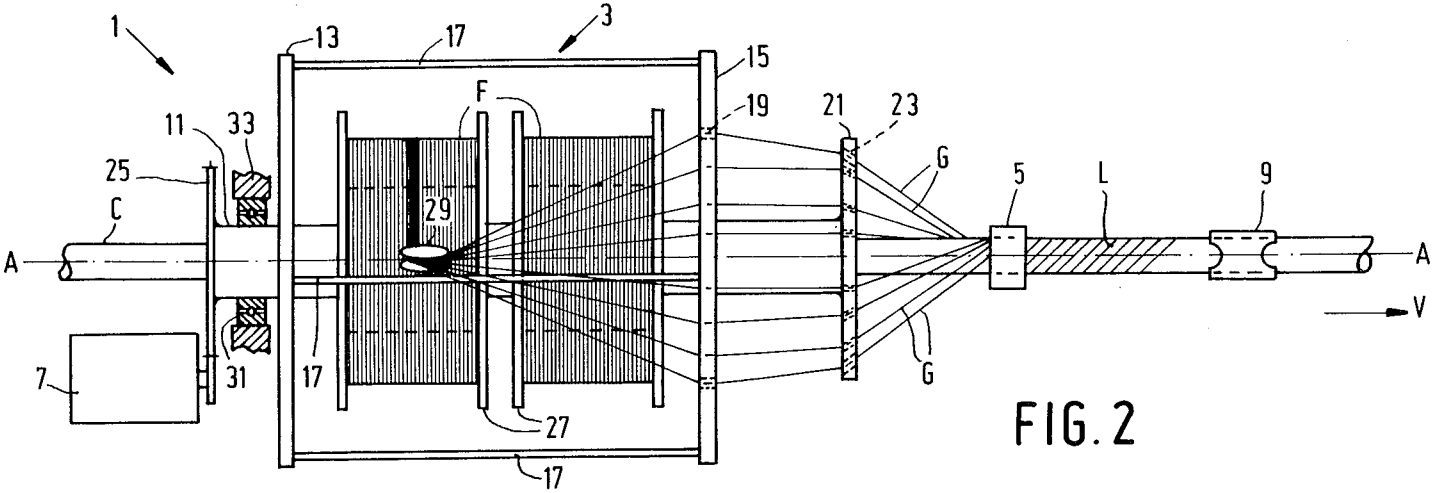
FIG. 2 is a plan view of the device shown in FIG. 1.

The device 1 shown in FIGS. 1 and 2 comprises a rotatable magazine 3, a stationary nipple 5, a motor 7 for driving the magazine 3 and drawing unit represented diagrammatically by two transport rollers 9 for the transport of the cable C. The magazine 3 is composed of a hollow shaft 11 on which are secured two flanges 13 and 15, which are interconnected by means of rods 17. The flange 15, which acts as a guide disk, is provided for this purpose with openings 19, which are distributed with an equal pitch distance along an arc of a given pitch circle adjacent the circumference of the flange. On one end of the hollow shaft 11 is secured a distributor disk 21, which is provided with guide holes 23, which are also distributed with an equal pitch distance along an arc of a given pitch circle adjacent the circumference of the distributor disk. On the other end of the shaft 11 is secured a drive wheel 25, which cooperates with the motor 7. In the embodiment shown, two feed reels 27 each carrying a coil F of wires G are journalled on the hollow shaft 11 so as to be freely rotatable relative thereto. The magazine 3 carries two guide wheels 29, one per feed reel. The hollow shaft 11 is journalled by means of a bearing 31 in the housing 33 of the device. The magazine 3 is further supported by supporting rollers 35, which cooperate with the two flanges 13 and 15.

As already described above, several wires G are wound parallel to and beside each other onto each feed reel 27. The cable C, which has to be provided with a concentric layer L of wires G, is guided through the hollow shaft 11 in a manner such that the central axis of the cable C substantially coincides with the axis A—A of the hollow shaft. After the wires G have been threaded through the openings 19, the guide holes 23 and the nipple 5 and finally fixed at these free ends to the cable C, the magazine 3 is driven by the motor 7 at a given speed of rotation, while the cable C is moved axially by the drawing unit 9 at a given linear speed in the direction of the arrow V. Due to these combined movements, the wires G are taken off each of the freely rotating feed reels 27 parallel to and beside each other in a tangential direction, are then directed towards the flange 15 by the respective guide wheel 29, are spread in the circumferential direction by the openings 19 in the flange 15, are guided by the guide holes 23 in the distributor disk 21 in the direction of the cable C and are finally wrapped by the stationary nipple 5 around the cable C to form the concentric layer L with a given pitch, which depends upon the ratio of the linear speed of the cable to the speed of rotation of the magazine. For practical reasons, at least two feed reels 27 are accommodated in the magazine 3 in order that a uniform distribution of the wires G over the full circumference of the cable C is obtained without problems.

The number of openings 19 in the flange 15 and the number of guide holes 23 in the distributor disk 21 is at least equal to the number of wires G to be processed and which are wound on the reels 27. Preferably, the flange 15 and the distributor disk 21 comprise a maximum number of openings 19 and guide holes 23, respectively, in order that different numbers of wires can be processed by means of the same device.

Figure 3:
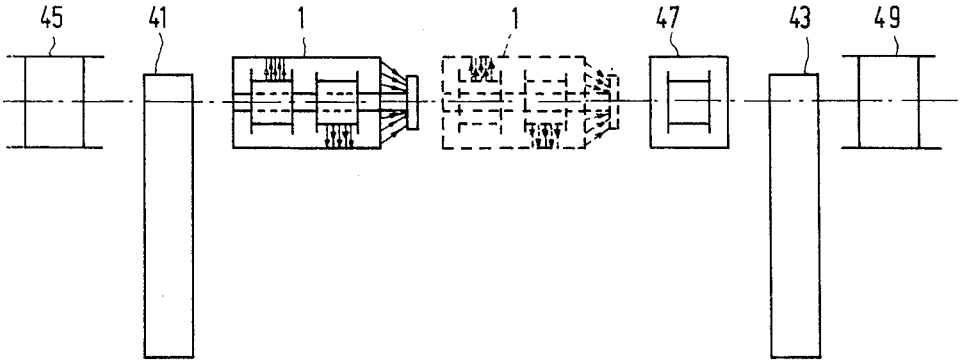
FIG. 3 shows a production line in which a device according to the invention is included.

Due to the fact that with the method according to the invention a higher production speed is obtained than with the conventional method, it is now possible to use the method in combination with other operations carried out on the cable and at the same stage in the processing of the cable. For this purpose, for example, as shown diagrammatically in FIG. 3, a device 1 according to the invention may be arranged between two extruders 41 and 43, of which the extruder 41 serves to apply an inner sheath to the cable, whilst by means of the extruder 43 an outer cable sheath is appled. Reference number 49 designates diagrammatically a take-up reel for storing the final product. Reference number 45 designates a supply reel carrying the cable to be wrapped comprising stranded wires. A second device 1 according to the invention is shown in dotted lines. Two such devices are arranged in series, for example, for applying two concentric layers of copper wires, the wires of one layer crossing the wires of the other layer and the magazines of the two devices having opposite directions of rotation. Such a wire wrapping having a two-layer structure serves as an alternative to the conventional braided outer conductor of coaxial cables. If desired, the extruder 43 may be preceded by a further device, for example a taping unit 47 comprising one or more reels with single tape for taping and fixing applied concentric wrapping of wire material.

The fact that the device according to the invention permits a comparatively high linear speed of the cable, is very compact and has more particularly a comparatively short length, provides the possibility of setting up at comparatively low investment cost a production line having a length which will permit several processing steps in the manufacture of a cable to be carried out efficiently and economically.

What is claimed is:

1. A method of providing a concentric layer of wire material on a cable, in which several wires are taken off feed reel means and are wrapped with a given pitch around the cable as it is moved along a rectilinear transport path, said method including taking a plurality of wires simultaneously off at least one common rotating feed reel in a tangential direction, said feed reel being disposed coaxially with the transport path of the cable, said plurality of wires being wound parallel to and beside each other on said feed reel, said wires being directed from the tangential direction into the direction of said transport path, said wires being spread in the circumferential direction at given pitch distances by guiding each of said wires to a different point located at the same predetermined circumference from said transport path, said points all lying in the same plane perpendicular to said transport path, and wrapping said wires around said cable with the same relative pitch distance.

2. A method as claimed in claim 1, characterized in that on said layer of wire material a second concentric layer of wire material is provided, the wires for the second layer being taken off at least one further rotating feed reel, which, viewed in the transport direction of the cable, is arranged behind the first feed reel, the arrangement being such that the wires of the second layer are wrapped crosswise over the first layer in a helical direction opposite to that of the wires in the first layer.

3. A device for providing a concentric layer of wire material on a cable, comprising a rotatable magazine, at least one feed reel and a guide means located in said magazine, a stationary nipple, a drive for the magazine and a drive for transporting the cable to be wrapped, characterized in that the device includes at least one feed reel having a plurality of wires thereon and a distributor disk means and that the magazine has a hollow rotatable shaft which serves as a support for said at least one feed reel and for said distributor disk means, said feed reel being coaxially journalled on said hollow shaft so as to be freely rotatable relative thereto, said hollow shaft at the same time serving as a passage for the cable to be wrapped, said distributor disc means distributing said wires in a circumferential direction at given pitch distances by guiding each of said wires to a different point, each point located at the same predetermined circumference from the longitudinal axis of said hollow shaft, said points all lying in the same plane perpendicular to said longitudinal axis.

4. A device as claimed in claim 3, characterized by at least one further magazine comprising at least one feed reel, a guide wheel and a distributor disk, by a second nipple and by a separate drive for the further magazine, the two magazines being arranged in series.

* * * * *